US007806782B2

(12) United States Patent
Stites et al.

(10) Patent No.: US 7,806,782 B2
(45) Date of Patent: Oct. 5, 2010

(54) GOLF CLUBS AND GOLF CLUB HEADS HAVING ADJUSTABLE WEIGHT MEMBERS

(75) Inventors: John Thomas Stites, Weatherford, TX (US); Robert Boyd, Euless, TX (US); Andrew G. V. Oldknow, Beaverton, OR (US); Eric A. Larson, Arlington, TX (US)

(73) Assignee: Nike, Inc., Beaverton, OR (US)

( * ) Notice: Subject to any disclaimer, the term of this patent is extended or adjusted under 35 U.S.C. 154(b) by 166 days.

(21) Appl. No.: 12/029,971

(22) Filed: Feb. 12, 2008

(65) Prior Publication Data

US 2009/0203462 A1 Aug. 13, 2009

(51) Int. Cl.
*A63B 53/04* (2006.01)
*A63B 53/06* (2006.01)

(52) U.S. Cl. ..... 473/334; 473/335; 473/338; 473/345; 473/349; 473/409

(58) Field of Classification Search ..... 473/324–350, 473/409
See application file for complete search history.

(56) References Cited

U.S. PATENT DOCUMENTS

| | | | | |
|---|---|---|---|---|
| 2,332,342 | A * | 10/1943 | Reach | 473/248 |
| 2,750,194 | A * | 6/1956 | Clark | 473/337 |
| 3,979,122 | A * | 9/1976 | Belmont | 473/336 |
| 4,043,563 | A * | 8/1977 | Churchward | 473/338 |
| 5,518,243 | A * | 5/1996 | Redman | 473/334 |
| 5,971,867 | A | 10/1999 | Galy | |
| 6,306,048 | B1 * | 10/2001 | McCabe et al. | 473/333 |
| 6,616,547 | B2 * | 9/2003 | Vincent et al. | 473/334 |
| 6,890,267 | B2 * | 5/2005 | Mahaffey et al. | 473/256 |
| 6,929,565 | B2 * | 8/2005 | Nakahara et al. | 473/345 |
| 7,448,963 | B2 * | 11/2008 | Beach et al. | 473/337 |
| 7,452,286 | B2 * | 11/2008 | Lin et al. | 473/334 |
| 7,520,820 | B2 * | 4/2009 | Dimarco | 473/334 |
| 7,611,424 | B2 * | 11/2009 | Nagai et al. | 473/334 |
| 2003/0083151 | A1 | 5/2003 | Nakahara et al. | |
| 2003/0232659 | A1 | 12/2003 | Mahaffey et al. | |

(Continued)

FOREIGN PATENT DOCUMENTS

WO 2007076304 A 7/2007

OTHER PUBLICATIONS

International Search Report and Written Opinion in corresponding PCT Application, International Application No. PCT/US2009/033559, mailed Jun. 9, 2009.

*Primary Examiner*—Sebastiano Passaniti
(74) *Attorney, Agent, or Firm*—Banner & Witcoff, Ltd.

(57) ABSTRACT

Wood-type golf club heads include: (a) a ball striking face; (b) a club head body engaged or integrally formed with the ball striking face, wherein the club head body includes a sole portion, wherein the sole portion includes a slot or rail defined therein; and (c) a weight member at least partially located within the slot or rail. The weight member may be mounted at plural positions along the slot or rail (optionally at least partially within a weight cartridge member provided with the club head body). The weight member also may be movably engaged with the weight cartridge member, slot, rail, and/or other portion of the club head body. Golf clubs including these club heads and methods of making and using such golf clubs and golf club heads also are described.

37 Claims, 6 Drawing Sheets

U.S. PATENT DOCUMENTS

2006/0122004 A1* 6/2006 Chen et al. ..... 473/335
2006/0172821 A1 8/2006 Evans
2006/0178228 A1* 8/2006 DiMarco ..... 473/334
2006/0240908 A1 10/2006 Adams et al.
2007/0238551 A1* 10/2007 Yokota ..... 473/349
2008/0146370 A1* 6/2008 Beach et al. ..... 473/336
2008/0261715 A1* 10/2008 Carter ..... 473/291
2010/0075773 A1* 3/2010 Casati, Jr. ..... 473/334

* cited by examiner

GOLF CLUBS AND GOLF CLUB HEADS HAVING ADJUSTABLE WEIGHT MEMBERS

FIELD OF THE INVENTION

The present invention relates to golf clubs and golf club heads. Particular example aspects of this invention relate to golf clubs and golf club heads having adjustable weight members.

BACKGROUND

In recent years, golf club heads and golf clubs have been designed to improve a golfer's accuracy by assisting the golfer in squaring the club head face at impact with a golf ball. A number of golf club heads have at least some weight of the golf club head positioned so as to alter or control the location of the club head's center of gravity. The location of the center of gravity of the golf club head is one factor that determines whether a golf ball will be propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively.

While the industry has witnessed dramatic changes and improvements to golf equipment in recent years, some players continue to experience difficulties in reliably hitting a golf ball in an intended and desired direction and/or with an intended and desired flight path. This is particularly true for clubs used to hit the ball long distances, such as drivers and woods. Accordingly, there is room in the art for further advances in golf club technology.

SUMMARY OF THE INVENTION

Wood-type golf club heads (e.g., drivers, fairway woods, wood-type hybrid clubs, or the like) according to at least some example aspects of this invention include: (a) a ball striking face; (b) a wood-type club head body engaged or integrally formed with the ball striking face, wherein the club head body includes a sole portion, wherein the sole portion includes a first slot or rail defined therein; and (c) a weight member at least partially located within the first slot or rail, wherein the weight member is mountable at plural positions along the first slot or rail (optionally at least partially within a weight cartridge member provided with or as part of the club head body). The weight member may be movably and/or removably engaged with the weight cartridge member, slot, rail, and/or other portion of the club head body.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this invention relate to methods for making golf club heads and golf club structures in accordance with examples of this invention. Such methods may include, for example: (a) providing a golf club head of the various types described above, e.g., by manufacturing or otherwise making the golf club head, by obtaining the golf club head from another source, etc.; (b) engaging a shaft member with the golf club head; (c) engaging a grip member with the shaft member; (d) engaging a weight cartridge member with the golf club head; and/or (e) engaging a weight member with one or more of the slot, rail, weight cartridge member, or other portion of the club head or club structure; etc.

BRIEF DESCRIPTION OF THE DRAWINGS

The present invention is illustrated by way of example and not limited in the accompanying figures, in which like reference numerals indicate similar elements throughout, and in which.

Figure 1A:
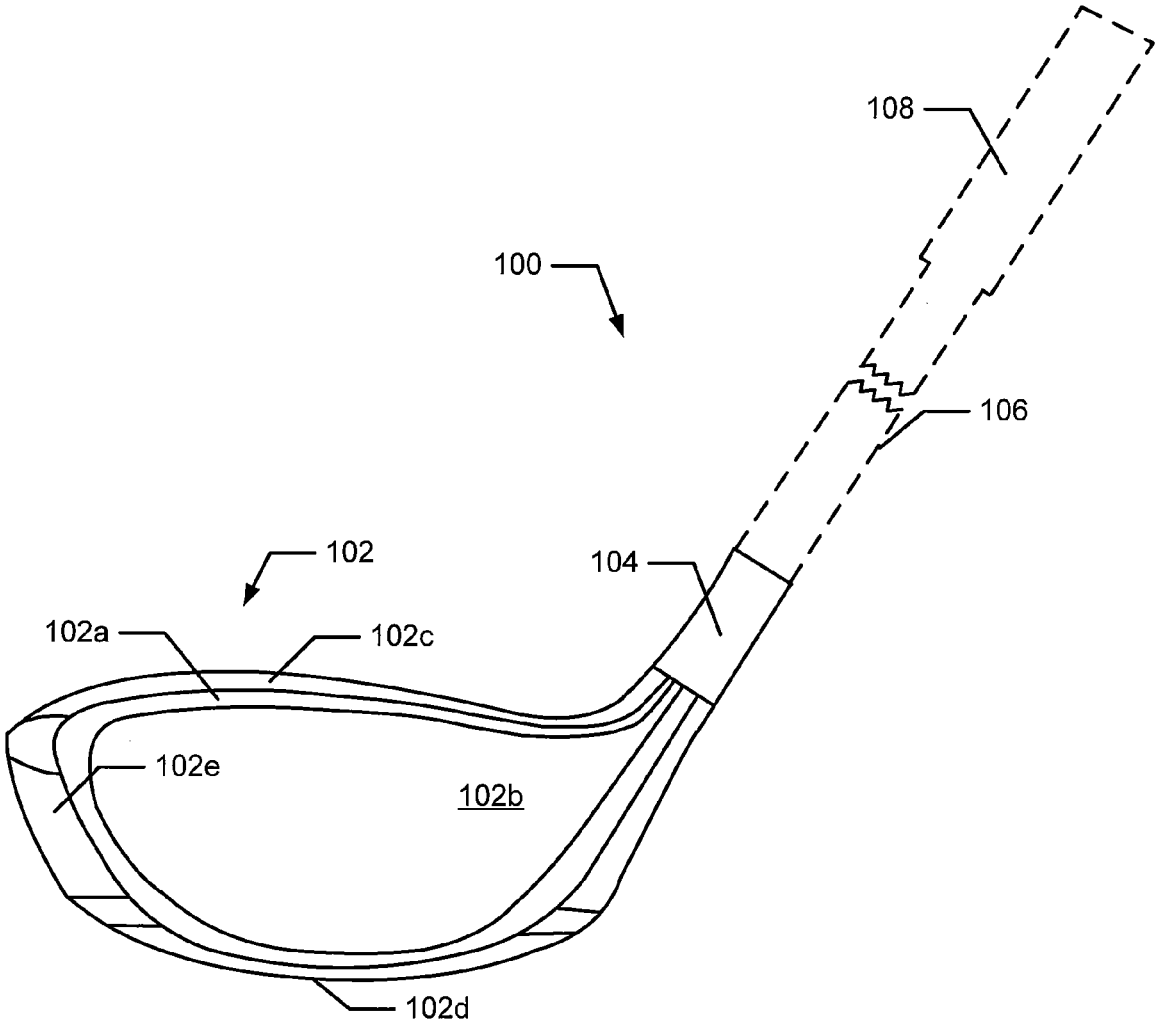
FIGS. 1A and 1B generally illustrate features of club head structures according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention (e.g., wood or wood-type hybrid golf clubs and golf club heads).

I. General Description of Example Golf Club Heads, Golf Clubs, and Methods in Accordance With This Invention Aspects of this invention relate to wood-type golf club heads and wood-type golf clubs including such club heads (e.g., drivers, fairway woods, wood-type hybrid clubs, or the like). Wood-type golf club heads according to at least some example aspects of this invention may include: (a) a ball striking face; (b) a wood-type club head body engaged or integrally formed with the ball striking face, wherein the club head body includes a sole portion, wherein the sole portion includes a first slot or rail defined therein; and (c) a weight member at least partially located within the first slot or rail, wherein the weight member is mountable at plural positions along the first slot or rail. Any desired portion of the weight member may be fit into the first slot or rail (e.g., at least some portion, all, or at least a major portion of the weight member may be located within the first slot or rail, etc.). Also, if desired, a weight cartridge member may be provided with the club head body (e.g., engaged in the first slot or rail, formed as part of the sole portion, etc.), and the weight member may be movably and/or removably engaged with the weight cartridge member.

The weight cartridge, slot, rail, and/or weight member may be provided at any desired location(s) in the club head body without departing from this invention. In some examples, the weight cartridge, slot, rail, and/or weight member will be provided in the sole portion of the club head body, optionally at least along a peripheral heel area of the sole portion, at least along a peripheral toe area of the sole portion, at least along a portion of an outer periphery of the sole portion, etc. The weight cartridge, slot, rail, and/or weight member also may be located and/or arranged so that the weight member may be selectively moved in any desired direction with respect to the club head body without departing from this invention, including, for example, mountable at plural positions around at least a portion of the periphery (optionally the sole or crown periphery) of the club head body, in the front-to-rear direction of the club head body (optionally along a central rail formed in the crown or sole portion of the club head body, etc.), or the like.

The wood-type golf club head body also may take on a variety of forms without departing from this invention. For example, the golf club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown portion, a sole portion, a face member (optionally including a ball striking face integrally formed therein or attached thereto), one or more body ribbons (e.g., forming or defining the periphery of the club head between the crown and sole portions), a sole plate, a frame member (optionally of metal, such as titanium alloys or the like, e.g., forming or defining the periphery of the club head between the crown and sole portions and/or to which one or more of the crown portion and/or the sole portion (if present) are engaged, etc.), an aft body, etc. The club head body may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, etc.). As yet another example, if desired, the club head body may have a unitary one piece construction, optionally with the slot and/or rail integrally formed therein, and further with a separate weight member (and optionally a separate weight cartridge, if desired) engaged therewith. Any desired structure and/or arrangement of the club head body structure and/or its various parts may be used without departing from this invention.

Also, any desired construction for the weight member, the slot, the rail, and/or the weight cartridge may be used without departing from the invention. If desired, the weight member may be movably and/or releasably engaged with the slot, rail, and/or weight cartridge in any desired manner without departing from this invention, including through the use of mechanical connectors, retaining member structures, spring-loaded connectors and/or retaining structures, and the like. More specific examples of weight members and their engagement with the remainder of a club head body are described below.

Additional aspects of this invention relate to wood-type golf club structures that include golf club heads, e.g., of the types described above. Such wood-type golf club structures further may include one or more of: a shaft member attached to the club head (optionally via a separate hosel member or a hosel member provided as a part of one or more of the club head and/or shaft); a grip or handle member attached to the shaft member; an additional weight member attached to one or more of the club head body, shaft, or grip; etc.

Still additional aspects of this invention relate to methods for making wood-type golf club heads and wood-type golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; (c) engaging a grip member with the shaft member; (d) engaging a weight cartridge member with the club head body; and/or (e) engaging one or more weight members with the club head, e.g., with the weight cartridge, slot, and/or rail, etc.

Additional aspects of this invention relate to methods of using wood-type golf club heads, e.g., of the various types described above. Such methods may include, for example, moving the weight member to various positions along the slot, rail, and/or weight cartridge; securing the weight member at various positions along the slot, rail, and/or weight cartridge; etc. In this manner, golf clubs and golf club heads in accordance with examples of this invention may be customized, e.g., to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according to the invention also may be used by club fitters to find desired or optimal weighting characteristics for specific users, and if desired, such characteristics may be used in selecting parts, arranging weights, and/or weighting for a final, permanently weighted club structure.

Given the general description of various example aspects of the invention provided above, more detailed descriptions of various specific examples of golf clubs and golf club head structures according to the invention are provided below.

II. Detailed Description of Example Golf Club Heads, Golf Club Structures, and Methods According to the Invention The following discussion and accompanying figures describe various example golf clubs and golf club head structures in accordance with the present invention. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., ribbons of material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of wood-type golf club heads and golf club structures according to this invention will be described in detail below in conjunction with the example golf club structures illustrated in FIGS. 1A through 3G.

Figure 1B:
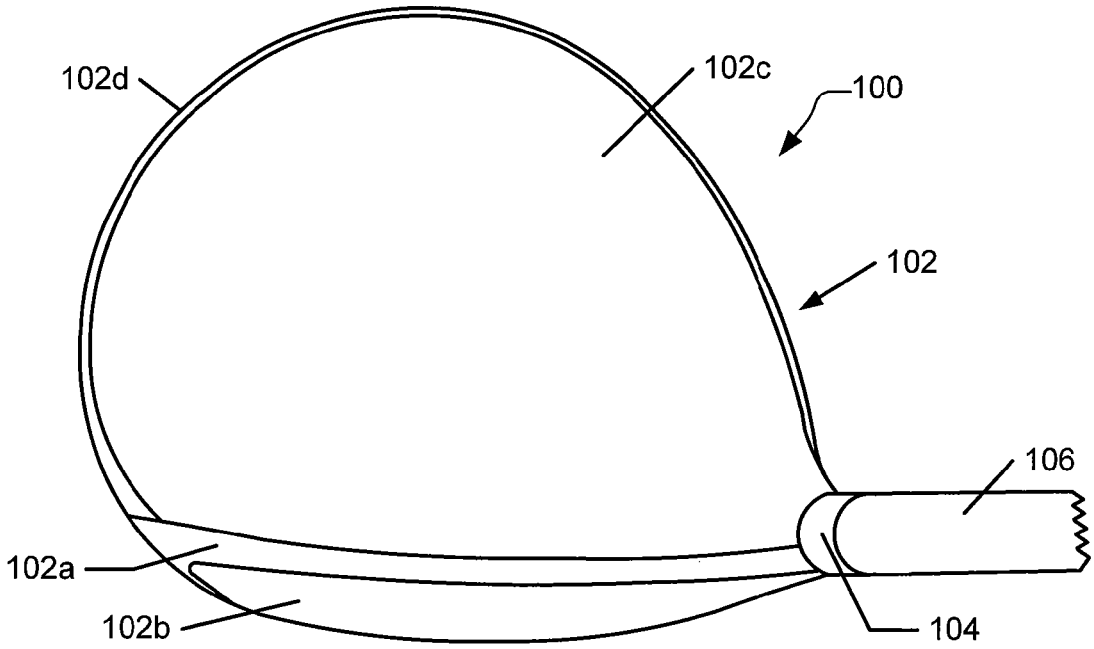

FIGS. 1A and 1B generally illustrate an example wood-type golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example structure 102 shown in FIGS. 1A and 1B, the club head 102 includes a ball striking face member 102*a* (including a ball striking face plate 102*b* integrally formed with the face member 102*a* or attached to a frame member such that the face plate 102*b* and frame member together constitute the overall face member 102*a*). The club head 102 of this illustrated example further includes a crown portion 102*c*, a sole portion 102*d*, and at least one body portion 102*e* located between the crown portion 102*c* and the sole portion 102*d* (e.g., a "ribbon" of material extending from the face member 102*a* toe to heel and around the club head periphery).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown portion 102*c*, sole portion 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium alloys, aluminum alloys, magnesium alloys, etc.

As additional examples or alternatives, in order to reduce the club head 102 weight, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member 102*e* (the regions or "ribbons" of material (e.g., one or more substantially "U-shaped" ribbons) extending between the crown portion 102*c* and the sole portion 102*d*) may be made from composite or other non-metal materials. As yet further examples, if desired, the entire body portion of the club head aft of a club head face member 102*a* (also called an "aft body"), or optionally the entire club head, may be made from composite or other non-metal materials without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown portion 102*c*, the sole portion, 102*d*, and/or the body portion(s) 102*e* may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The club head may have any desired volume, including, for example, a volume of at least 200 cc, and in some examples at least 350 cc, at least 400 cc, at least 420 cc, or even at least 450 cc.

Figure 2A:
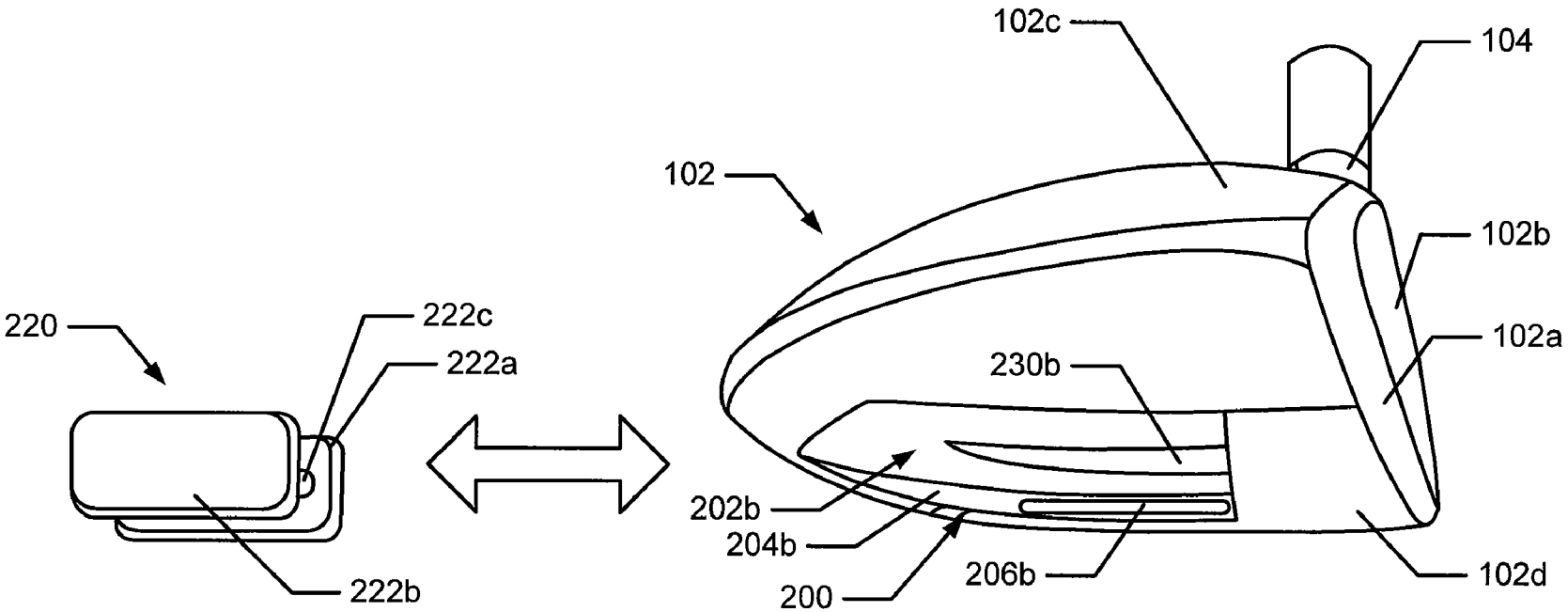
FIGS. 2A through 2C illustrate a golf club head structure including a weight mounting rail structure that may be used in accordance with at least some examples of this invention.
Figure 2B:
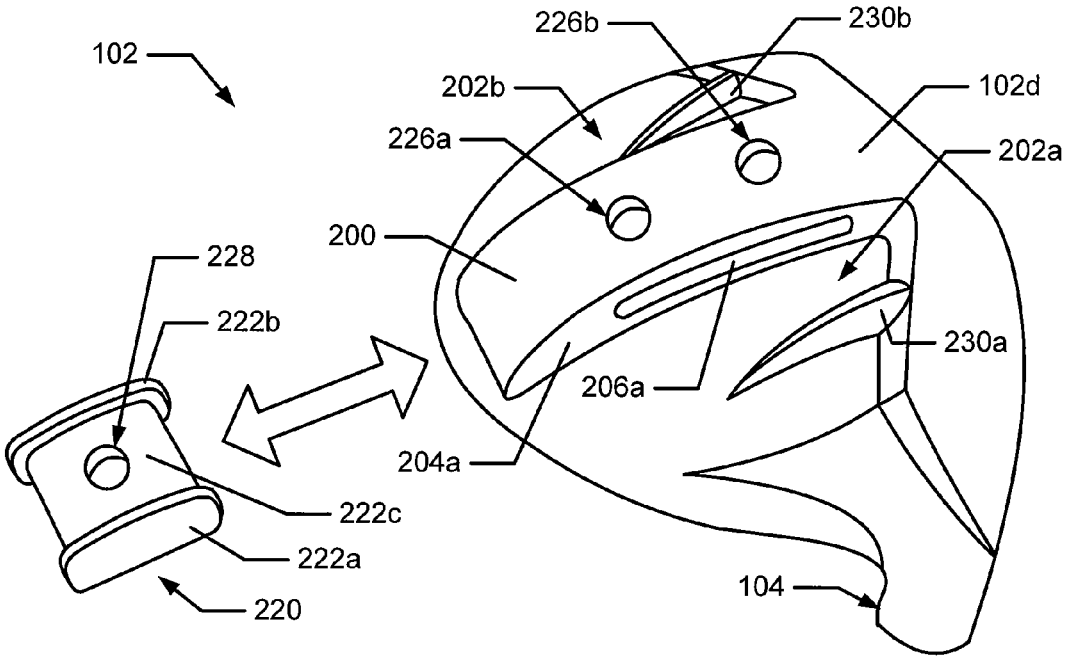
Figure 2C:
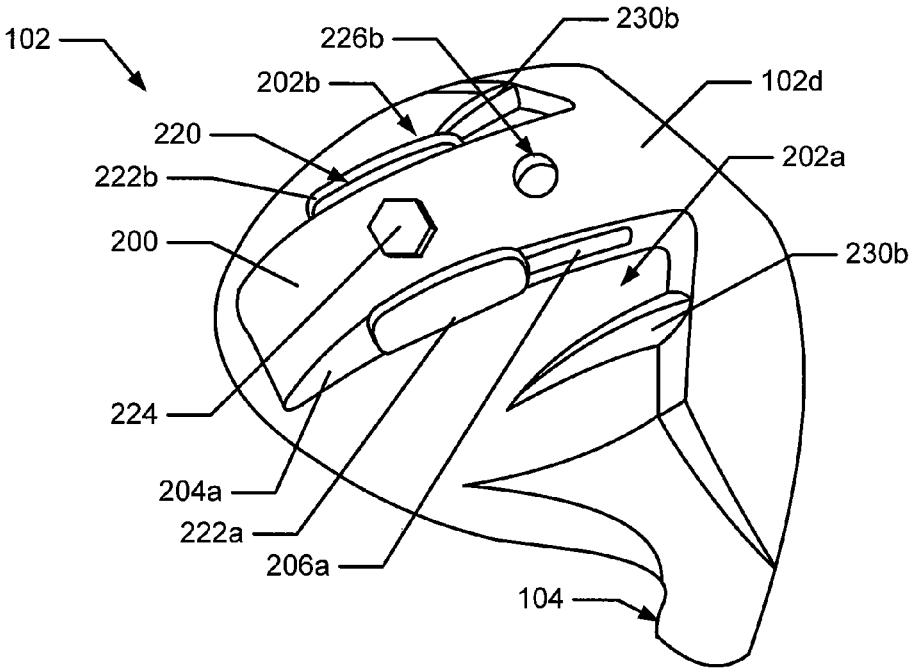

FIGS. 2A through 2C illustrate additional example features and structures that may be included in golf club 100 and golf club head 102 structures in accordance with this invention. As shown in these figures, the bottom or sole portion 102*d* of this club head structure 102 includes a raised rail portion 200 located in the central area of the sole portion 102*d* and extending in a direction from the front of the club head structure 102 toward its rear. Recessed areas are defined adjacent to and alongside the raised rail portion 200, one recessed area 202*a* located toward the heel portion of the club head structure 102 and another recessed area 202*b* located toward the toe portion of the club head structure 102. A wide variety of sizes, shapes, positioning, orientations, and/or relative orientations for the raised rail portion 200 and/or the recessed areas 202*a* and/or 202*b* are possible without departing from this invention. Also, different numbers of raised rail portions 200 and/or recessed areas 202*a* and/or 202*b* may be provided in a club head structure 102 without departing from this invention (e.g., multiple rail portions 200 arranged toe-to-heel, multiple rail portions 200 arranged front-to-back, etc.). If desired, the rail portions 200 may extend at an angle along the club sole 102*d*, e.g., in a direction from the heel toward the toe as one moves rearward, in a direction from the toe toward the heel, as one moves rearward, etc. The rail 200 also may be curved, if desired, e.g., along the outer periphery of the club along the toe and/or heel sides, along the outer rear of the club, along the bottom sole portion of the club away from the periphery, etc.

In this illustrated example, the side surfaces 204*a* and 204*b* of the rail portion 200 (facing the heel recessed area 202*a* and the toe recessed area 202*b*, respectively) include openings or grooves 206*a* and 206*b* defined therein. A weight member 220 may be engaged with the raised rail portion 200, as illustrated, for example in FIG. 2C using these openings or grooves 206*a* and/or 206*b*. The weight member 220 may be engaged with the raised rail portion 200 in a variety of ways without departing from this invention. For example, in this illustrated structure 102, the weight member 220 includes two end elements 222*a* and 222*b* with a central portion 222*c* extending therebetween. One or both of the end elements 222*a* and/or 222*b* may be removable from the central portion 222*c* to enable the central portion 222*c* to extend through the openings 206*a* and 206*b* (to thereby mount the weight member 220 on the rail portion 200). Then, the removed end element(s) 222*a* and/or 222*b* may be reattached to the central portion 222*c*. Any way of securing and releasing the end element(s) 222*a* and/or 222*b* to/from the central portion 222*c* may be used without departing from this invention, including, for example: friction fits, mechanical connectors, retaining member/groove or opening structures, spring loaded mechanisms, etc. If necessary or desired, the end element(s) 222*a* and/or 222*b* may be sized and positionable such that they do not extend beyond the bottom surface of the rail portion 200 (e.g., so that the end elements 222*a* and/or 222*b* will not contact the ground when the user makes a stroke). Furthermore, if desired, the end elements 222*a* and/or 222*b* may have different sizes and/or masses (and/or may be made of different materials) to enable users and/or club fitters to selectively place additional weight toward the club head's toe or heel areas (e.g., to provide a fade or draw bias to the club head, to help compensate for swing flaws to correct hook or slice ball flights, etc.).

The weight member 220 also may be secured at a desired position along the rail portion 200 in a variety of ways. In this illustrated example, a screw or bolt member 224 is provided to secure the weight member 220 at one of plural discrete positions on the rail portion 200. Two mounting holes 226*a* and 226*b* (optionally threaded) are defined on the bottom surface of the rail portion 200 in this illustrated example, and the screw or bolt member 224 may be arranged to engage a hole 228 in the weight member 220 (optionally threaded) through one of these holes 226*a* or 226*b* to thereby hold the weight member 220 in place with respect to the rail portion 200. If desired, the exposed head of screw or bolt member 224 may fit into a countersink opening provided in the bottom surface of the rail portion 200 so that the screw or bolt 224 head does not extend beyond the bottom surface of the rail portion 200 (e.g., so that it will not contact the ground when the user makes a stroke). Of course, any number of screw or bolt attachment holes (e.g., 226*a*, 226*b*, etc.) may be provided in the rail portion 200, to allow mounting of the weight member 220 at any desired number of discrete positions, without departing from this invention. If desired, cover members may be provided (not shown) to cover any exposed or open holes (e.g., hole 226*b* in FIG. 2C, the remainder of grooves 206*a* and 206*b*, etc.) to prevent dirt or debris from entering the rail portion 200 and/or the club head body interior during use.

A wide variety of other ways of securing the weight member 220 in place with respect to the rail portion 200 are possible without departing from this invention. For example, if desired, the rail portion 200, the grooves or openings, 206*a* and/or 206*b*, and/or the weight member 220 may be provided with extending surfaces (such as detent mechanisms, spring mounted projections, etc.) that fit into corresponding and/or mating openings, slots, or the like provided in the other member. As another example, the side surface(s) 204*a* and/or 204*b* of the rail portion 200 may include openings for receiving screws, bolts, or the like, e.g., that extend through the end portions 222*a* and/or 222*b* of the weight member 220 (e.g., such that an end portion 222*a* and/or 222*b* may be secured to its respective side surface 204*a* and 204*b*). In such structures, no central portion 222*c* of weight member 220 need be provided (e.g., if desired, the end portions 222*a* and/or 222*b* may attach to their respective side wall surfaces 204*a* and 204*b* without the need to have any portion of the weight member 220 extend into the rail portion 200). As yet additional examples, set screws may extend through the rail portion 200 to engage the weight member 220 (e.g., through the bottom surface of rail portion 200 to engage the center portion 222*c* of the weight member, to engage openings or holes in the center portion 222*c*, etc.). In still other examples, rather than allowing mounting of the weight member 220 at discrete, pre-selected positions (e.g., as shown by the mounting holes 226*a* or 226*b* in FIGS. 2A through 2C), the weight member 220 and/or rail portion 200 may include structures so as to allow the weight member 220 to be mounted at any position along the rail portion 200. Such structures may include, for example, anchors or locking mechanisms, e.g., that include a structural expansion capability on central portion 222*c* of weight member 220 or a structural contraction capability on the rail portion 200 or grooves 206*a* and/or 206*b* to allow the central portion 222*c* to butt up against and tightly engage the sides of the opening(s) 206*a* and/or 206*b*. The expansion and/or contraction capabilities may be selectively activated, for example, when a user turns a screw member in one direction, when a user pushes the two end portions 222*a* and 222*b* together, when a user moves a switch to a pre-selected position, etc. As more specific examples, such locking and/or anchoring mechanisms may be selectively activated and/or allow relative movement in a manner akin to the way microphone stands are movable and adjustable to a wide variety of different positions.

Moving the weight member 220 forward and/or backward on the rail portion 200 (which also may have the effect of moving the weight member 220 somewhat up or down in the club head structure 200, e.g., if the rail portion 200 is angled or curved) may allow users or club fitters to affect the flight of balls propelled using club heads 102 and golf clubs 100 in accordance with these examples of the invention. For example, it is typically easier for at least some users to get a golf ball airborne using a club head 102 having significant weight located lower and toward its rear (e.g., with the weight member 220 in the position shown in FIG. 2C). Such weight positioning also may be used to provide a higher, more lofted golf ball flight path, at least for some users. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, the weight member 220 may be positioned more forward on the rail portion 200, toward the ball striking face (e.g., mounted at hole 226*b* in the example structure 102 illustrated in FIGS. 2A through 2C).

The openings or grooves 206*a* and/or 206*b*, as well as the overall rail portion 200 may take on a wide variety of structures without departing from this invention. For example, the rail portion 200 may be hollow, solid, etc., and the entire area or portion of material between openings or grooves 206*a* and 206*b* may be removed or omitted such that an open slot is provided completely through the interior of the rail portion 200. As additional alternatives, if desired, one or both of the side walls 204*a* and/or 204*b* may include a groove 206*a* and 206*b*, respectively, that does not extend completely through the rail portion 200. In such example structures, one or more independent weight members may be mounted to the rail portion 200, e.g., one (or more) independent weight member at each side wall 204*a* and 204*b*, one or more weight members on side wall 204*a*, one or more weight members on side wall 204*b*, etc. Such structures provide still additional options for selective weighting (e.g., to bias the club head for specific ball flight types, to compensate for swing flaws, etc.). One or more locking or anchoring mechanisms for the weight member(s), e.g., of the types described above, may be provided to hold the weight member in place with respect to the rail portion 200.

While FIGS. 2A through 2C illustrate the rail portion 220 in the center of the club head 102 sole portion 102*d*, if desired, the rail portion 220 may be offset, e.g., located toward the heel side or the toe side, and/or plural rail portions 220 may be provided on a club head structure without departing from this invention. Additionally or alternatively, if desired, plural rail portions may be provided, e.g., one in the heel area and one in the toe area, optionally with weight members mounted in or an at least some or all of the rail portions, without departing from this invention. The rail portion 220 also may be angled along the sole (e.g., in a direction from the front heel toward the rear toe, in a direction from the front toe toward the rear heel, etc.) or curved along the sole (e.g., to ride along the outer heel and/or toe periphery of the club head sole, to ride along the rear periphery of the sole, etc.). As one more specific example, if desired, rail portions 230*a* and 230*b* may be used for mounting a suitable weight member (e.g., a weight member that slides over or around rail portions 230*a* and/or 230*b* and secures thereto, for example, using one of the anchoring and/or locking mechanisms described above). Such side rail portions 230*a* and 230*b* may be used in addition to or in place of the central rail portion 200. Such side rail portions 230*a* and/or 230*b*, when present, may take on a wide variety of sizes, shapes, orientations, and the like, including the various sizes, shapes, and/or orientations described above with respect to rail portion 200.

Figure 3B:
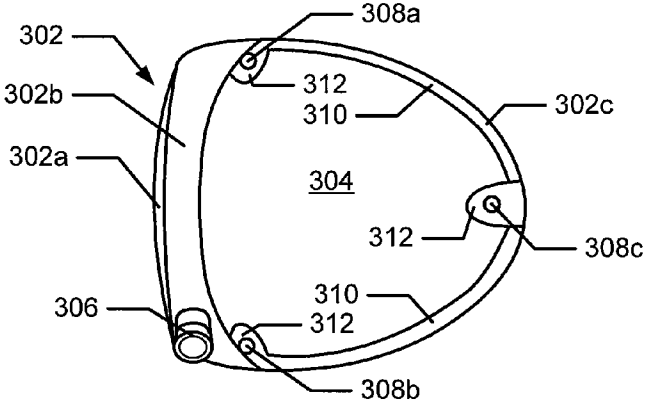
FIGS. 3A through 3G illustrate a golf club head structure including a weight cartridge member structure that may be used in accordance with at least some examples of this invention.
Figure 3A:
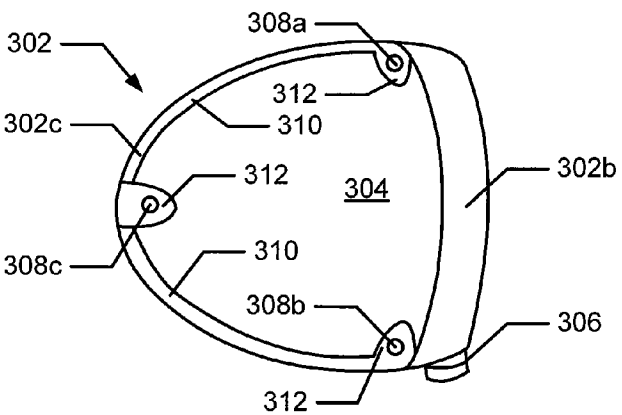

FIGS. 3A through 3G illustrate another example golf club head structure 300 in accordance with this invention and/or various portions thereof (including an example construction of such a club head 300). FIGS. 3A and 3B illustrate a bottom and top view, respectively, of a frame member 302 for this example golf club head structure 300. In this example, the base member 302 is constructed from a metal material (e.g., titanium alloys, or the other metal materials described above) and includes a ball striking plate 302*a*, a ball striking plate frame member 302*b*, and a ribbon or body portion 302*c* that extends from the heel portion to the toe portion of the ball striking plate frame member 302*b* and defines at least a portion of an outer perimeter of the club head structure 300. The ribbon or body portion 302*c*, along with the ball striking plate frame member 302*b*, defines an open area 304. While a single piece construction is shown in FIGS. 3A and 3B, frame member 302 may be made of any desired number of individual parts, secured together in any desired manner, including, for example: via mechanical connectors; welding, brazing, soldering, or other fusing techniques; adhesives or cements; etc. Also, while a metal construction is described above, frame member 302 (or individual portions thereof) may be made from any desired materials without departing from this invention, including, for example, materials conventionally used in the golf club art. The body portion 302*c* of frame member 302 may remain at least partially exposed in the final club head structure 300, or it may be covered in the finally assembled club head product.

FIGS. 3A and 3B further illustrate that the frame member 302 includes a hosel portion 306 (or an opening or some other structure) for receiving a shaft member (not shown in FIGS. 3A through 3G). Any desired hosel construction or materials, shaft member construction or materials, and/or manner of connecting the shaft member to the hosel 306 (or other portion of the club head structure) may be used without departing from this invention, including constructions, materials, and/or attachments techniques that are conventionally known and/or used in the art. In this illustrated example, the hosel member 306 is integrally formed as part of the frame member 302, for example, formed during casting, machining, molding, etc. of the material making up the frame member 302.

The frame member 302 of this example structure further includes mounting members 308*a*, 308*b*, and 308*c* that may be used for securing other parts of the overall club head structure 300 to the frame member 302 (and/or to one another), as will be described in more detail below. The mounting or contact surfaces 310 of ribbon or body portion 302*c* of the frame member 302 (optionally, as well as the mounting or contact surfaces of the ball striking plate frame member 302*b*, if any) and the mounting or contact surfaces 312 of the mounting members 308*a*, 308*b*, and 308*c* (e.g., the surfaces through which the openings are formed) form a solid base for mounting and securing other portions of the overall club head structure 300, as will be described in more detail below. Of course, any number of mounting members 308*a*, 308*b*, and 308*c*, of any desired sizes, shapes, locations, and/or orientations, may be provided without departing from this invention. Also, the mounting or contact surfaces 310 and 312 of the various portions of the frame member 302 may be provided in any desired sizes, shapes, locations, and/or orientations (e.g., generally horizontal, sloping, stepped, with mating structures, etc.) without departing from this invention.

Figure 3D:
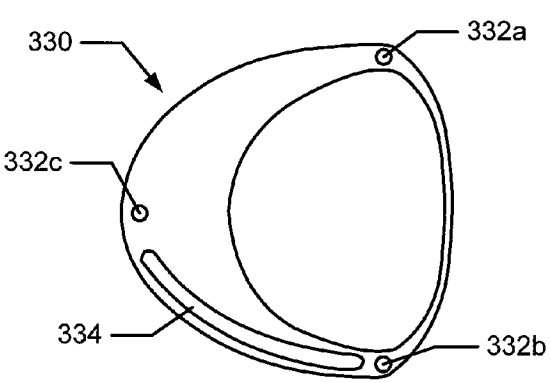
Figure 3C:
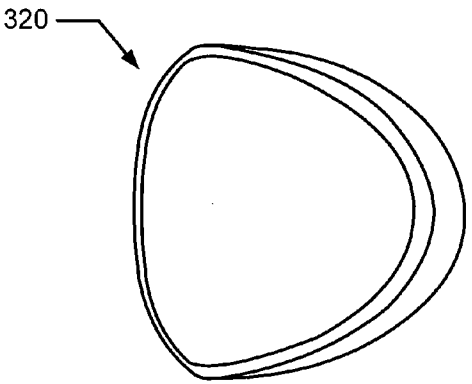

FIG. 3C illustrates a top (exterior) view of an example crown member 320 that may be included in a club head structure 300 of the type illustrated in FIGS. 3A through 3G. In this illustrated example structure, the crown portion 320 fits over the upper opening 304 of the frame structure 302 shown in FIG. 3B. The rim or perimeter of the crown portion 320 in this example (e.g., the underside rim or perimeter from that shown in FIG. 3C) may include appropriate structures to engage with the mounting or contact surface(s) 310 of the ribbon or body portion 302*c* of the frame member 302 and/or the mounting or contact surfaces 312 of the mounting members 308*a*, 308*b*, and 308*c* (e.g., ridges, extending portions, grooves, or the like that match up to and engage corresponding structures in the frame member 302, etc.). If desired, as will be described in more detail below, the underside of the crown portion 320 may be formed to include appropriate structures (such as threaded holes at the locations of mounting members 308*a*, 308*b*, and 308*c*, etc.) that engage mechanical connectors (such as screws) to hold the crown portion 320, the sole portion 330 (described below), and the frame member 302 together.

FIG. 3D illustrates a top (exterior) view of an example sole portion 330 that may be included in the golf club head structure 300 shown in FIGS. 3A through 3G. This sole portion 330 fits over the opening 304 of the frame structure 302 shown in FIG. 3A. The rim or perimeter of the sole portion 330 in this example (e.g., the underside rim or perimeter from that shown in FIG. 3D) may include appropriate structures to engage with the mounting or contact surface(s) 310 of the ribbon or body portion 302*c* of the frame member 302 and/or the mounting or contact surfaces 312 of the mounting members 308*a*, 308*b*, and 308*c* (e.g., ridges, extending portions, grooves, or the like that match up to and engage corresponding structures in the frame member 302, etc.). As shown, this example sole portion 330 includes openings 332*a*, 332*b*, and 332*c* for receiving mechanical connectors for holding the overall the club head structure together. The mechanical connectors (e.g., screws, rivets, turnbuckles, etc.) may extend through the openings 332*a*, 332*b*, and 332*c*, through the openings in the mounting members 308*a*, 308*b*, and 308*c*, respectively, in the frame member 302, and into receptacles provided in the underside of the crown portion 320 (e.g., threaded holes, nuts, etc.). Alternatively, if desired, the crown portion 320 also may include openings, and the bolts or other connectors may extend all the way through the club head structure 300. In these manners, the crown portion 320, the sole portion 330, and the frame member 302 may be held together.

The crown portion 320, sole portion 330, and frame member 302 may be held together in other ways as well, without departing from this invention. For example, mechanical connectors other than screws or bolts may be used, such as retaining members, spring loaded detents or other mechanisms, etc. As still additional examples, if desired, adhesives or cements, as well as soldering, brazing, welding, and/or other fusing techniques may be used, at least in part, to hold one or more of the various parts of the club head structure 300 together and/or to one another. Also, any combination of techniques, such as the techniques described above, may be used to hold one or more of the various parts of the club head structure 300 together.

The crown member 320 and/or the sole member 330 may be made from any desired materials, including the same or different materials (and the same or different material(s) from the frame member 302) without departing from this invention. In at least some example structures, the crown member 320 and/or the sole member 330 will be made of a lightweight material, such as: a polymeric material; a composite material (such as carbon fiber composites, fiberglass materials, basalt fiber composites, and the like); a lightweight metal material (e.g., titanium alloys, aluminum alloys, magnesium alloys, etc.). Additionally, the crown member 320 and/or the sole member 330 may be made from conventional materials that are known and used in the golf club art. These parts also may be made from and formed into desired shapes using fabrication techniques that also are well known and used in the art (e.g., by molding techniques, such as blow molding or injection molding of polymeric materials, molding or shaping of composite materials, etc.; by conventional metal fabrication and shaping techniques, such as molding, shaping, casting, forging, machining, etc.; and the like).

If desired, the crown member 320 and/or the sole member 330 may serve as mounting elements or bases for still further elements, such as finishing materials (e.g., paint, enamel, or other finishing materials) to provide a desired aesthetic appearance; a sole plate (e.g., made of metal or other durable materials) to protect at least portions of the club head structure during use (e.g., when the club head contacts the ground during a swing, etc.); etc. Use of such additional elements may be accomplished in conventional ways that are known and used in the art. As a more specific example, a sole plate (optionally made from a metal material) may be fixed to the sole portion 320, e.g., using mechanical connectors, cements, adhesives, etc.

FIG. 3D illustrates another feature provided in club head structures 300 according to at least some examples of this invention. Notably, in this example structure, the sole portion 330 includes a slot, groove, or opening 334 defined therein. This slot, groove, or opening 334 may be used for mounting a weight member, examples of which will be described in more detail below. The slot, groove, or opening 334 may be open or "bottomless" (e.g., so that it opens into an open or hollow space defined by the crown portion 320, the frame member 302, and the sole portion 330) or closed (e.g., extending only partially through the crown portion, abutting up against the frame portion 302, etc.) without departing from this invention.

The slot, groove, or opening 334 may take on any desired size or shape, and it may be provided at any desired position or location in the club head structure (e.g., in the sole portion structure 330, in the crown portion structure 320, in the body portion 302*c* of frame member 302, etc.) without departing from this invention. Also, if desired, the club head structure 300, including any individual part thereof (e.g., the sole portion 330, etc.), may include more than one slot, groove, or opening 334 for receiving weight members. Also, any number of separate and individual weights may be mounted in the various slots, grooves, or openings 334 without departing from this invention (e.g., one slot, groove, or opening 334 may include any desired number of weight members, including zero, one, two, or more, etc.). In this illustrated example structure, the sole portion 330 includes a single slot, groove, or opening 334 that extends from the side heel location (e.g., near the club head's hosel member 306) to the central rear portion of the sole portion 330, along the outer periphery of the sole portion 330. Such constructions enable users (or club fitters) to provide additional weight in the heel and/or rear portion(s) of an overall club head structure 300, which can be useful to provide a draw biased club and/or a club that helps compensate for swing flaws that typically produce an excessively fading or slicing ball flight. Additionally or alternatively, a similar slot, groove, or opening 334 may be provided along the outer periphery on the toe side of the sole portion 330. Such constructions enable users (or club fitters) to provide additional weight in the toe and/or rear portion(s) of an overall club head structure 300, which can be useful to provide a fade biased club and/or a club that helps compensate for swing flaws that typically produce a drawing or hooking ball flight.

Figure 3E:
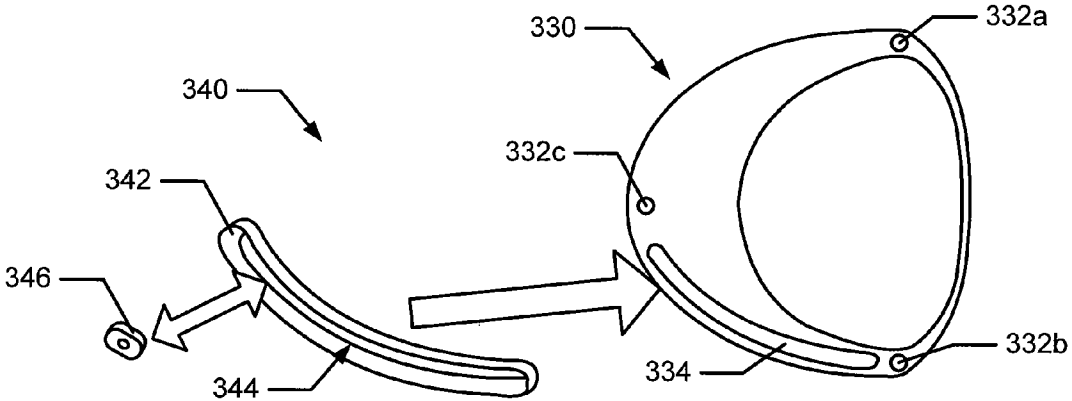

If desired, one or more weight members may be directly engaged with the slot, groove, or opening 334 in the sole portion 330 of the club head structure 300. The weight member(s) may be held in place in any desired manner, including in a releasable or removable manner, permanently mounted therein, etc., including through the use of mechanical connectors (e.g., screws, bolts, spring-loaded retaining elements, detents, friction fits, etc.), fusing techniques (e.g., adhesives, cements, welding, brazing, soldering, etc.), and the like. FIG. 3E, however, illustrates another possible construction that may be used in accordance with at least some examples of this invention. As shown, in this example structure 340, a weight cartridge member 342 is mounted in the slot, groove, or opening 334 of the sole portion 330. The weight cartridge member 342 may be designed to fit flush with the remainder of the surface of the sole portion 330, extend somewhat out from the sole portion 330, or, if desired, countersunk into the sole portion 330. The weight cartridge member 342 may be made from any desired materials, including, for example, metal alloy materials, polymeric materials, etc. (e.g., any of the materials used in constructing the golf club head 300, as described above, any other material typically used in golf club construction, etc.). The weight cartridge member 342 may be secured to the sole portion 330 (and/or other portion of the club head structure 300) in any desired manner, such as through the use of mechanical connectors, fusing techniques, or the like.

The weight cartridge member 342 of this example structure 340 includes an open channel 344 into which one or more weight members 346 may be mounted. The weight member (s) 346 may be mounted in the channel 344 in any desired manner without departing from this invention, including using mechanical connectors (e.g., screws, turnbuckles, etc.), spring-loaded mechanisms (e.g., detents, spring-biased retaining elements fitting into openings in the channel 344 wall, etc.), other retaining members and/or retaining groove structures, and the like. Also, the channel 344 and/or weight member(s) 346 may be provided with structures so as to allow mounting at plural, discrete positions along the channel 344, or the securing mechanisms may allow mounting at any desired position(s) along the channel without departing from this invention (e.g., using various securing, locking, or anchoring structures, like those described above in conjunction with FIGS. 2A through 2C). The weight member 346 (as well as at least some portions of weight members 220 described above) may be made from lead, tungsten, lead-containing materials, tungsten-containing materials, and/or other heavy or dense materials. The weight members may be made of other materials as well.

The weight cartridge member 342 may be secured with the sole portion 330 at any desired time in the club head manufacturing process without departing from this invention. In the illustrated example of FIG. 3E, the weight cartridge member 342 is shown attached to the sole portion 330 before the sole portion 330 is attached to the frame member 302 and/or the crown portion 320. Other construction techniques are possible, such as attachment of the weight cartridge member 342 to the sole portion 330 after the sole portion 330, the crown portion 320, and frame member 302 (or other club head components) are engaged together. Also, if desired, the weight cartridge member 342 need not be secured only to the sole portion 330. Rather, if desired, the weight cartridge member 342 may be secured to one or more of the crown portion 320 and/or the frame member 302 (or other club head components) in addition to or in place of its attachment to the sole portion 330. Also, the weight cartridge member 342 may be provided in other portions of the club head structure, such as in the crown portion 320 and/or the frame member 302, and optionally not in the sole portion, without departing from this invention. Any number of weight cartridge members 342, at any desired locations in an overall club head structure 300, may be used without departing from this invention.

Figure 3G:
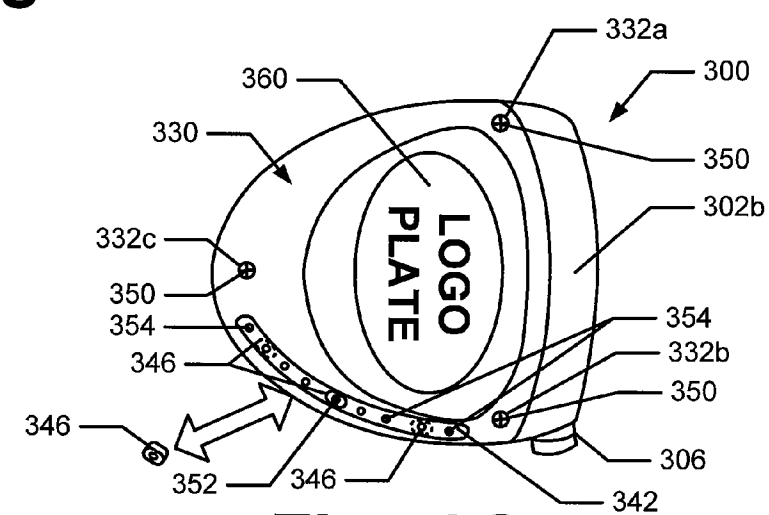
Figure 3F:
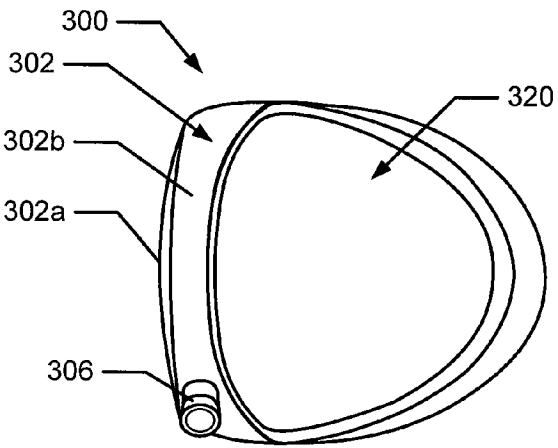

FIGS. 3F and 3G illustrate top and bottom views, respectively, of the overall club head structure 300 according to this example of the invention. The crown portion 320 and the sole portion 330 may be engaged with the frame member 302 in any desired manner, for example, to overlay the frame member 302, to fit underneath or inside the frame member 302, etc. Also, in this example structure 300, as described above, the crown portion 320, the sole portion 330, and the frame member 302 may be engaged together using mechanical connectors, such as screw members 350. If necessary and/or desired, the heads of the screw members 350 may be countersunk into the sole portion 330, so that these members 350 will not stick out and/or directly contact the ground when a ball is struck.

Also, FIG. 3G illustrates that the weight member 346 (or multiple weight members 346, if desired) may be mounted at a variety of different positions along the weight member cartridge 342 (as indicated by the broken line representations of the weight member 346 in FIG. 3G). In this illustrated example, a screw member 352 extending through the weight member 346 is used to mount the weight member 346 at one of plural possible positions 354 in the cartridge 342 (although a wide variety of other mounting techniques are possible, as described above). These features, as described above, allow users and/or club fitters (or other third parties) to selectively position the weight member(s) 346 as desired in the overall club head structure, e.g., to bias the club head 300 provide a desired ball flight path, to compensate for swing flaws, etc.

FIG. 3G further shows the inclusion of a sole plate 360 over at least some part of the sole portion 330. The sole plate 360 may be made, for example, from a metal or other durable material, to help protect the sole portion 330 and/or provide desired ground engagement characteristics for the overall club head. The sole plate 360 also provides a location for inclusion of a logo, model name, loft identifier, club head identifier, or other information, if desired. The sole plate 360, when present, may be attached in any desired manner without departing from this invention, including, for example, via mechanical connectors (such as screws, rivets, etc.); adhesives, cements, or other fusing techniques, etc.

Also, if desired, all or some portion(s) of the open channel 344 of the weight member cartridge 342 may be covered with one or more cover members (not shown). Such cover members can help prevent loss of weight members, accumulation of dirt or debris, etc. The cover member(s), when present, may be attached to the club head 300 and/or cartridge 342 in any desired manner, including through friction fits, mechanical connectors, cements, adhesives, etc.

While various weight attaching structures and techniques are described above (e.g., weight members mounted to a rail and/or to a weight cartridge member) in conjunction with various specific structures shown in FIGS. 1A through 3G, features and aspects of this invention may be applied to a wide variety of club head structures or constructions without departing from the invention. For example, a wide variety of constructions, numbers of parts, combinations of materials, and the like may be used, including constructions, parts, and combinations of materials that are known and used in the art. More specific examples of additional potential club head constructions that may include weight attaching structures and/or weighting techniques of the types described above include, but are not limited to: one piece club constructions, e.g., of metallic or metal alloy materials, polymer-containing materials, or composite-containing materials, either as a solid material or a having a hollow interior chamber within the club head; constructions having a face member (e.g., a face frame member with a face plate attached thereto or integrally formed therewith) with an aft body attached thereto (the aft body may be constructed from one or more of metallic or metal alloy materials, polymer-containing materials, or composite-containing materials, either as a solid material or a having a hollowed out interior chamber); multi-piece constructions, e.g., constructions having a face member (e.g., a face frame member with a face plate attached thereto or integrally formed therewith) with a multi-piece body attached thereto (the body may be constructed from one or more of metallic or metal alloy materials, polymer-containing materials, or composite-containing materials, e.g., including one or more of a crown member, a sole member, one or more body ribbons, etc); etc. A wide variety of other constructions also are possible.

Weight adjustable golf club heads of the types described above may be used by golfers, on the golf course, for their regular play (users can maintain the ability to modify the weight settings and/or customize the club head to their swing characteristics). As another example, however, golf club heads in accordance with at least some examples of this invention (e.g., of the types described above) also may be useful for club fitting purposes. For example, by providing movable weights of the types described above, club fitters and/or users can quickly adjust the playing characteristics of a club head by adjusting the position(s) of the weight members provided with the club head. In this manner, a user being fit for new clubs and/or club components can quickly try different weighting characteristics for the club head using a single club head (as opposed to the club fitter having to carry a large inventory of club heads each with slightly different weighting characteristics). Then, when a weight arrangement and/or orientation is found that best suits a user's swing characteristics and/or provides a desired ball flight path, based on the adjustable club head's settings (e.g., the position of the weights, the mass of the weights, etc.), the club fitter can order or build a club head for the user having permanent weighting characteristics based on and derived from the movable and adjustable weights used during the fitting session(s).

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 3G may be used individually and/or in any combination or subcombination without departing from this invention.

We claim:

1. A wood-type golf club head, comprising:

a ball striking face;

a wood-type club head body engaged or integrally formed with the ball striking face, wherein the club head body includes a sole portion, wherein the sole portion includes a first rail defined therein, the first rail including an aperture formed in a sidewall of the first rail; and a weight member at least partially located within the first rail and engaged with the aperture formed in the sidewall of the first rail, wherein the weight member is mountable at plural positions along the first rail and the first weight member includes:

a first end element, a second end element, and an intermediate element extending between the first end element and the second end element, wherein the intermediate element extends through the aperture formed in the sidewall of the first rail and the first and second end elements are located at least partially outside the first rail.

2. A wood-type golf club head according to claim 1, wherein at least a major portion of the weight member is located within the first rail.

3. A wood-type golf club head according to claim 1, wherein the club head body includes:

a metal alloy part including or engaged with the ball striking face, and a sole member engaged with the metal alloy part, wherein the sole member has the first rail defined therein.

4. A wood-type golf club head according to claim 3, wherein the club head body further includes a crown member engaged with the metal alloy part.

5. A wood-type golf club head according to claim 4, wherein the crown member includes a polymeric material.

6. A wood-type golf club head according to claim 4, wherein the crown member includes a composite material.

7. A wood-type golf club head according to claim 4, wherein the crown member includes a fiber-reinforced composite material.

8. A wood-type golf club head according to claim 3, wherein the sole member includes a polymeric material.

9. A wood-type golf club head according to claim 3, wherein the sole member includes a composite material.

10. A wood-type golf club head according to claim 3, wherein the sole member includes a fiber-reinforced composite material.

11. A wood-type golf club head according to claim 3, wherein the metal alloy part includes a frame member that defines at least a portion of a rear periphery of the club head body.

12. A wood-type golf club head according to claim 1, wherein the first rail extends in a front-to-rear direction of the club head body.

13. A wood-type golf club head according to claim 1, wherein the first rail extends along a central region of the sole portion, in a front-to-rear direction of the club head body.

14. A wood-type golf club head according to claim 1, wherein the first rail extends in a front-to-rear direction of the club head body.

15. A wood-type golf club head according to claim 1, wherein the first rail extends along a central region of the sole portion, in a front-to-rear direction of the club head body.

16. A wood-type golf club head according to claim 1, wherein the sole portion includes a central area extending in a front-to-rear direction of the club head body, a first recessed portion adjacent the central area and located toward a heel of the club head body, and a second recessed portion adjacent the central area and located toward a toe of the club head body.

17. A wood-type golf club head according to claim 16, wherein the first rail is defined in the central area of the sole portion.

18. A wood-type golf club head according to claim 16, wherein the weight member extends into or at least partially through the central area.

19. A wood-type golf club head according to claim 1, wherein an opening to the first rail faces away from the sole portion.

20. A wood-type golf club head according to claim 1, wherein an opening to the first rail faces a heel portion of the club head body.

21. A wood-type golf club head according to claim 1, wherein an opening to the first rail faces a toe portion of the club head body.

22. A wood-type golf club head according to claim 1, wherein the club head body constitutes a unitary, one-piece construction.

23. A wood-type golf club head according to claim 1, wherein the club head body constitutes a driver body.

24. The wood-type golf club head of claims 1, wherein the first end element is connected to the intermediate element at a first end of the intermediate element and the second end element is connected to the intermediate element at an opposite end of the intermediate element.

25. The wood-type golf club head of claim 1, wherein one of the first and second elements is located adjacent the sidewall of the first rail.

26. A wood-type golf club head, comprising:

a ball striking face;

a wood-type club head body engaged or integrally formed with the e ball striking face, wherein the club head body includes a sole portion, wherein the sole portion includes a first rail defined therein, the first rail including an aperture formed in a sidewall of the first rail; and a weight member at least partially located within the first rail and engaged with the aperture formed in the sidewall of the first rail, wherein the weight member is mountable at plural positions along the first rail and wherein the weight member includes a first end element and an extending element extending from the first end element, wherein the extending element extends into or through the aperture formed in the first rail and the first end element is located at least partially outside the first rail.

27. A wood-type golf club, comprising:

a club head including a ball striking face and a wood-type club head body engaged or integrally formed with the ball striking face, wherein the club head body includes a sole portion, wherein the sole portion includes a first rail defined therein, the first rail having an aperture formed in a sidewall of the first rail, the aperture extending entirely through the first rail, from a first sidewall to a second sidewall;

a weight member at least partially located within the first rail and engaged with the aperture, wherein the weight member is mountable at plural positions along the first rail; and a shaft member engaged with the club head.

28. The wood-type golf club of claim 27, wherein the first rail extends along a central region of the sole portion, in a front-to-rear direction of the club head body.

29. A wood-type golf club head, comprising:

a ball striking face;

a wood-type club head body engaged or integrally formed with the ball striking face, wherein the club head body includes a sole portion, wherein the sole portion includes a first rail defined therein, the first rail including an aperture formed in a sidewall of the first rail; and a weight member at least partially located within the first rail and engaged with the aperture formed in the sidewall of the first rail, wherein the weight member is mountable at plural positions along the first rail, and wherein the aperture extends entirely through the first rail, from a first sidewall to a second sidewall.

30. A wood-type golf club, comprising:

a club head including a ball striking face and a wood-type club head body engaged or integrally formed with the ball striking face, wherein the club head includes a sole portion, wherein the sole portion includes a first rail defined therein, the first rail having an aperture formed in a sidewall of the first rail;

a weight member at least partially located within the first rail and engaged with the aperture, wherein the weight member is mountable at plural positions along the first rail and the weight member includes a first end element, a second end element, and an intermediate element extending between the first end element and the second end element, wherein the first end element is connected to the intermediate element at a first end of the intermediate element and the second end element is connected to the intermediate element at an opposite end of the intermediate element; and a shaft member engaged with the club head.

31. The wood-type golf club of claim 30, wherein the intermediate element extends through the aperture formed in the first rail and the first and second end elements are located at least partially outside the first rail.

32. A method of producing a wood-type golf club head, comprising:

providing a club head including a ball striking face and a wood-type club head body engaged of integrally formed with the ball striking face, wherein the club head body includes a sole portion, wherein the sole portion includes a first rail defined therein;

forming an aperture in a sidewall of the first rail; and providing a weight member, wherein the weight member fits at least partially within the first rail and is engaged with the aperture, the weight member is mountable at plural positions along the first rail, wherein providing the weight member includes providing a weight member having a first end element, a second end element and an intermediate element extending between the first end element and the second end element and wherein the step of providing the weight member further includes providing the intermediate element extending through the aperture and connecting the first end element to a first end of the intermediate element and connecting the second end element to an opposite end of the intermediate member.

33. The method of producing a wood-type golf club head of claim 32, wherein forming an aperture in a sidewall of the first rail includes forming an aperture extending entirely through the first rail.

34. The method of producing a wood-type golf club head of claim 32, wherein the first rail extends along a central region of the sole portion.

35. A method of producing a wood-type golf club, Comprising:

providing a club head including a ball striking face and a wood-type club head body engaged or integrally formed with the ball striking face, wherein the club head body includes a sole portion, wherein the sole portion includes a first rail defined therein and an aperture formed in a sidewall of the first rail, and wherein the club head further includes a weight member at least partially within the first rail and engaged with the aperture, wherein the weight member is mountable at plural positions along the first rail and the weight member further includes a first end element, a second end element and an intermediate element extending between the first end element and the second end element, and wherein the intermediate element of the weight member extends through the aperture and the first end element is connected to a first end of the intermediate element and the second end element is connected to an opposite end of the intermediate member; and engaging a shaft member with the club head body.

36. The method of producing a wood-type golf club of claim 35, wherein the aperture extends entirely through the first rail.

37. The method of producing a wood-type golf club of claim 35, wherein the first rail extends in a front-to-rear direction of the club head body.

* * * * *

UNITED STATES PATENT AND TRADEMARK OFFICE

CERTIFICATE OF CORRECTION

PATENT NO. : 7,806,782 B2
APPLICATION NO. : 12/029971
DATED : October 5, 2010
INVENTOR(S) : John Thomas Stites et al.

It is certified that error appears in the above-identified patent and that said Letters Patent is hereby corrected as shown below:

Column 18, Claim 30, Line 50:

Please delete "club head includes" and insert --club head body includes--.

Signed and Sealed this
Eighteenth Day of January, 2011

David J. Kappos

David J. Kappos
*Director of the United States Patent and Trademark Office*